United States Patent [19]

Selvi

[11] 4,133,276

[45] Jan. 9, 1979

[54] STOCKING TOE END CLOSING APPARATUS

[75] Inventor: Fabio Selvi, Florence, Italy

[73] Assignee: Speizman Industries, Inc., Charlotte, N.C.

[21] Appl. No.: 769,654

[22] Filed: Feb. 17, 1977

[30] Foreign Application Priority Data

Feb. 20, 1976 [IT] Italy ..... 9356 A/76
Jun. 28, 1976 [IT] Italy ..... 9498 A/76

[51] Int. Cl.[2] ..... D05B 21/00

[52] U.S. Cl. ..... 112/121.15; 112/153; 112/287; 112/DIG. 2

[58] Field of Search ..... 112/121.15, 121.11, 112/121.12, 121.29, 287, 153, DIG. 1, DIG. 2; 223/112, 43

[56] References Cited

U.S. PATENT DOCUMENTS

| | | | |
|---|---|---|---|
| 3,452,691 | 7/1969 | Ditrich | 112/121.15 |
| 3,602,172 | 8/1971 | Bray | 112/287 |
| 3,738,294 | 6/1973 | Christiansen | 112/121.15 |
| 3,859,938 | 1/1975 | Fukuyama | 112/121.15 |
| 3,875,880 | 4/1975 | Hazelgrove et al. | 112/121.15 |
| 3,886,877 | 6/1975 | Akaishi et al. | 112/121.15 |
| 3,952,673 | 4/1976 | Fukuyama | 112/121.15 |

*Primary Examiner*—H. Hampton Hunter
*Attorney, Agent, or Firm*—Richards, Shefte & Pinckney

[57] ABSTRACT

Stocking toe end closing apparatus of the type having a series of horizontal stocking turning tubes mounted on a rotatable base for indexing to a position for spreading stocking toe ends carried on the supports, and for further indexing to a seaming position where the stocking toe ends are closed. The turning tubes are connected to a suction source at index positions before and after the spreading and closing positions for everting stockings thereat. Spreading fingers are inserted into the open free ends of the supported stockings at the spreading position and expand through longitudinal slots in the tubes for lateral spreading of the stocking toe ends to a width suitable for seaming, and the fingers are then moved away from the support end in a diagonal direction with respect to the elongation of the tubes in synchronism with the index motion of the tube, so that the stocking toe end is carried by the fingers to a position where the fingers and the toe end extremity lie beyond an arcuate clamp which then engages the widespread toe end in position for rotation of the clamp and the toe end extremity past a sewing machine for closing. Tubular guards with matching longitudinal slots are provided for exposing alignment and shielding non-alignment with the slots in the tube ends to prevent interference with the everting of stockings by the tube end slots. Exhaust air produced from the same suction source that provides suction for everting stockings is passed through a nozzle adjacent the clamp onto the toe end extremity for directing it into the sewing machine. The clamp rotates in reverse direction after seaming to pay out the stocking which has wrapped partly around it during seaming, in synchronism with the index motion of the stocking support away from the seaming position. An endless belt is supported in deflected engagement with the stocking tube at the seaming index position, and during a portion of its index motion to and away from that position, as a means of restraining the stocking from sliding off the support as it is partially withdrawn for positioning the toe end at the sewing machine and by wrapping around the clamp during seaming.

26 Claims, 18 Drawing Figures

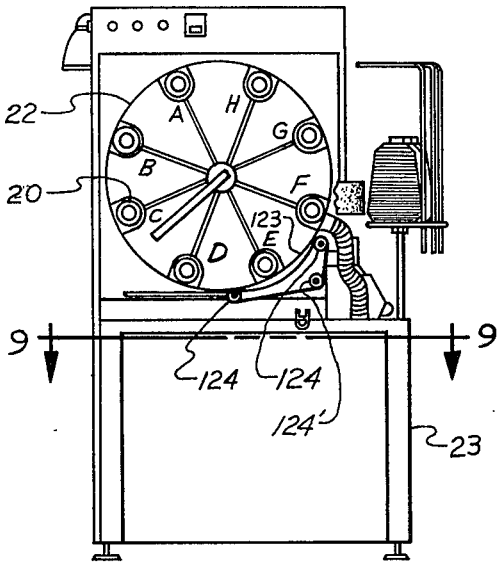
Fig. 3
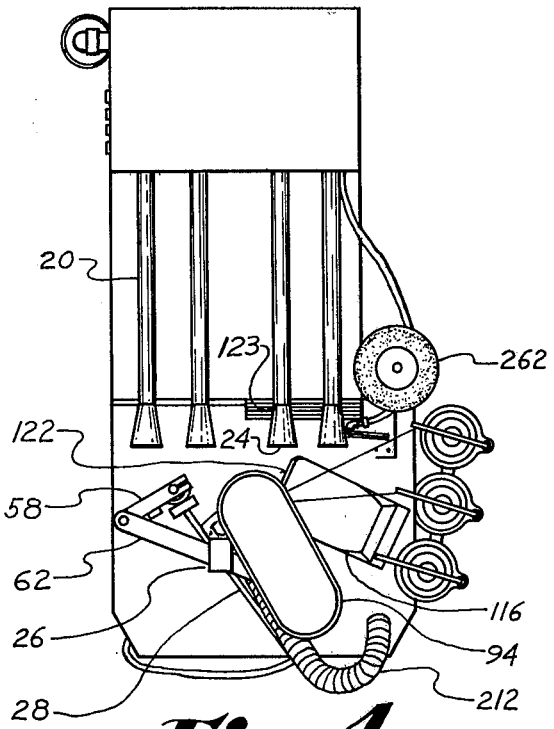
Fig. 4
Fig. 5
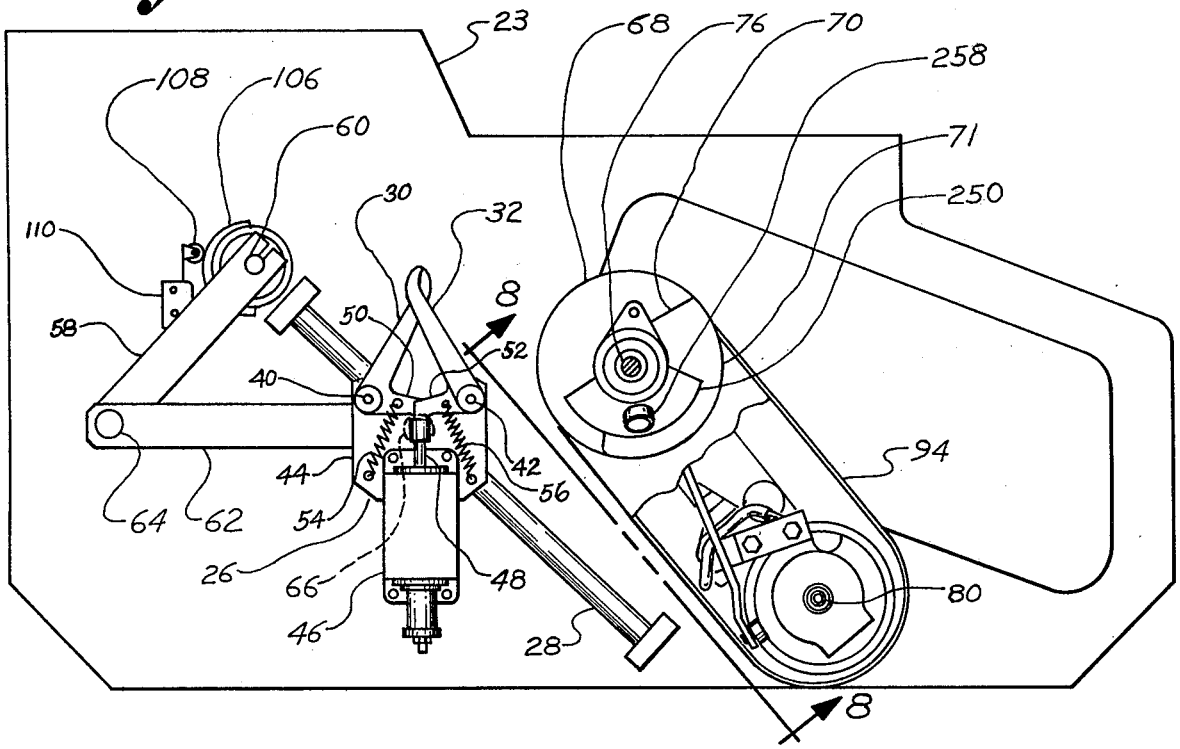

1

2

3

4

5

6

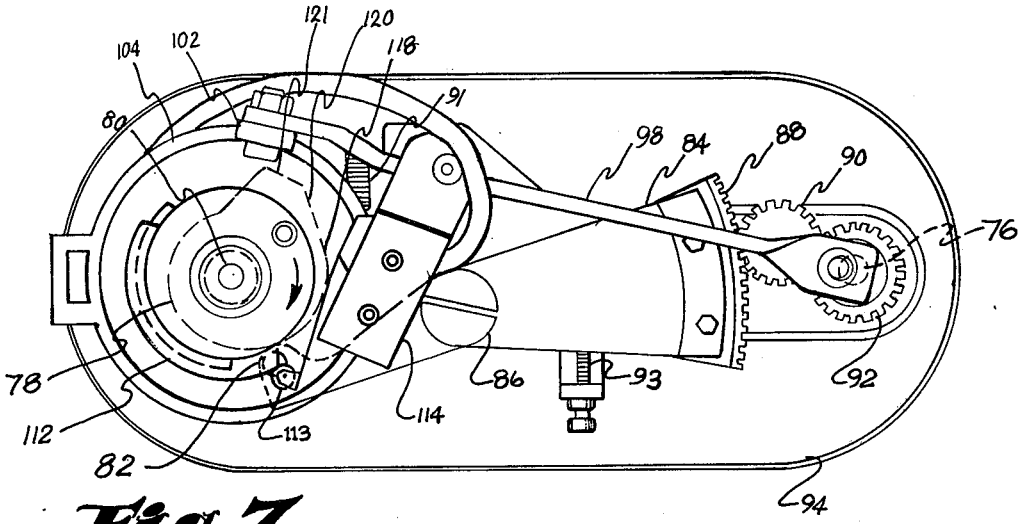
Fig. 7
Fig. 8
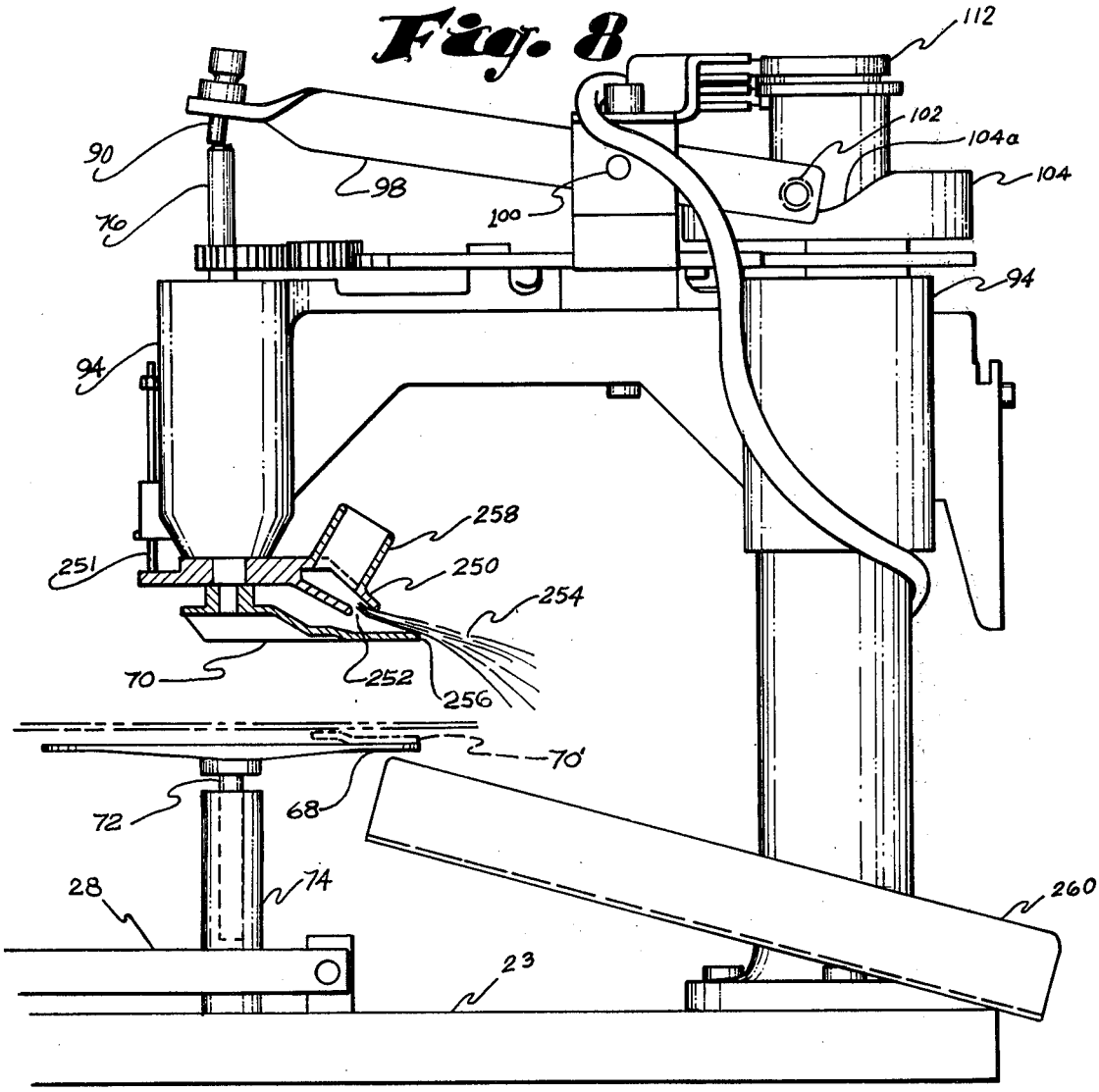

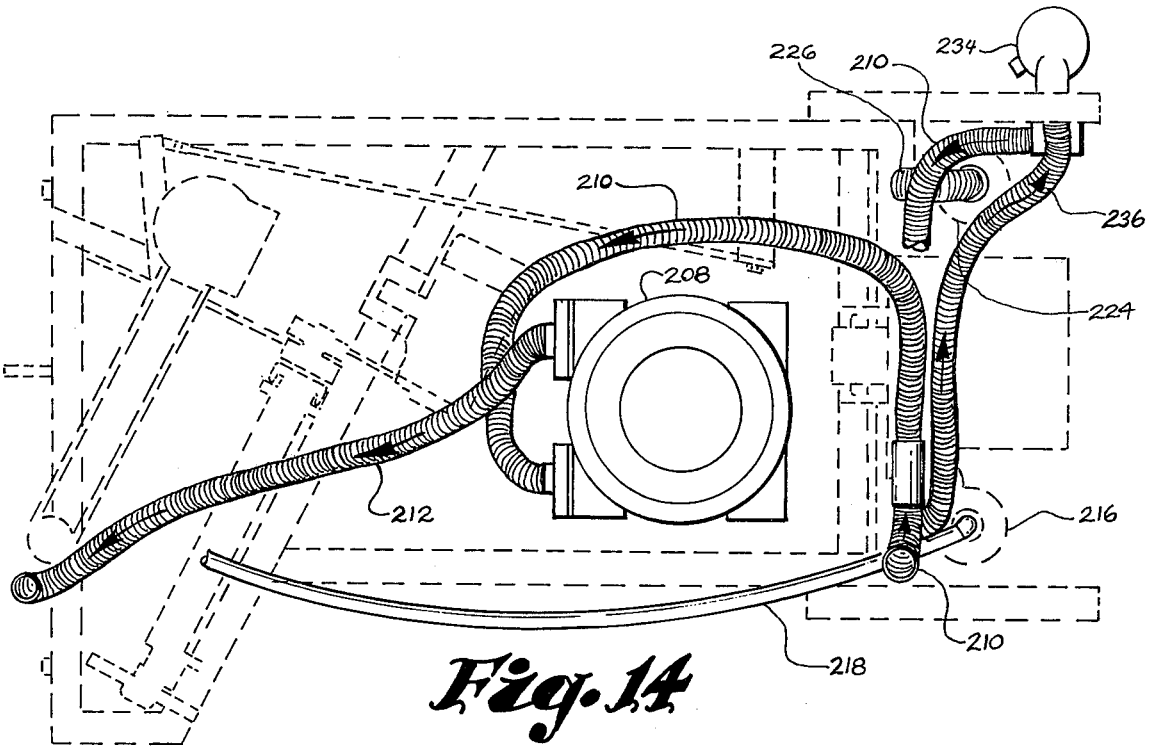
Fig. 14
Fig. 15
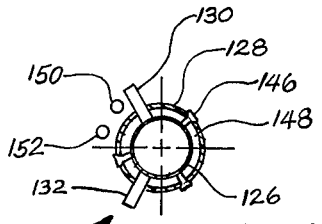
Fig. 17
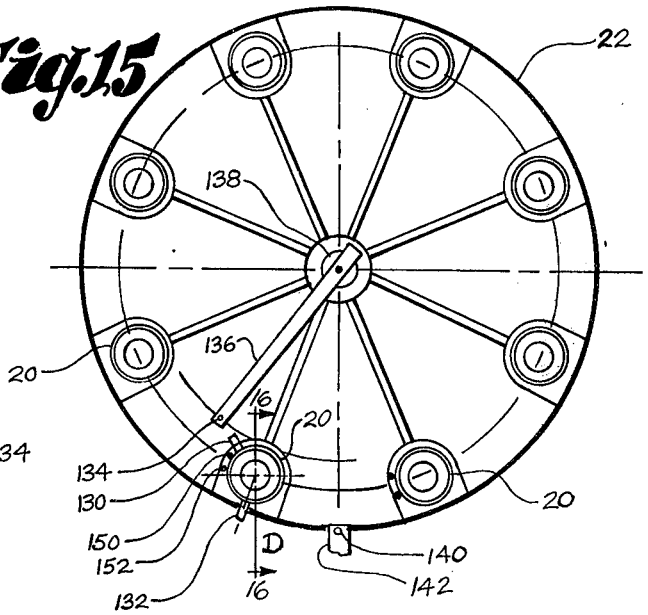
Fig. 18
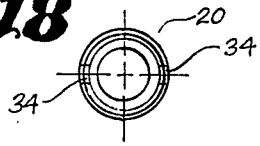
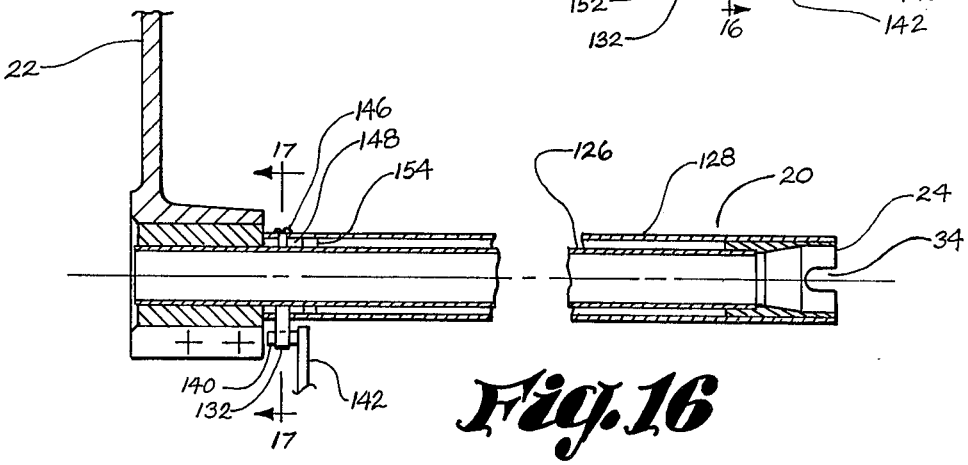
Fig. 16

STOCKING TOE END CLOSING APPARATUS

BACKGROUND OF THE INVENTION

The present invention relates to apparatus for closing the toe ends of stockings, and more particularly to apparatus that automatically supports and transfers stocking toe ends to and through a toe end seaming operation.

Many attempts have been made to provide apparatus useful for stocking toe closing without satisfactory success. A typical example of such prior art apparatus is that shown in U.S. Pat. No. 3,738,294, which discloses indexing turning tubes on which stockings are supported for manual spreading and positioning of stocking toe ends from the turning tubes onto a thin flat carrier that moves the spread toe end into a clamp that clamps both the spread toe end and the carrier and from which the carrier is withdrawn, leaving the spread toe end in the clamp with its extremity outside the clamp for feeding through an adjacent sewing machine upon rotation of the clamp. In other forms of prior art apparatus of this type the turning tubes or other supports for stockings are advanced directly into clamps, which clamp both the stocking and support and from which the support is withdrawn while the clamp retains the stocking in as accurate a position as possible for seaming. An example of the latter type of apparatus is disclosed in U.S. Pat. No. 3,941,069, which discloses spreading elements within the stocking support member and operable to expand and spread a supported stocking toe end for clamping.

In all of the prior apparatus that mechanically positions the stocking toe ends in clamps rather than this being done manually, the apparatus requires positioning of the carrier, spreading means or end of the stocking support within the clamp and it is necessary to withdraw the carrier, spreader or support end from the clamp while leaving the stocking toe end in place. This provides problems of mechanical construction and operation, difficulty in controlling and maintaining control of the position of the stocking toe end when the carrier, spreader or support end is removed from the clamp. Further, the prior apparatus requires either manual spreading of the stocking toe ends or a complicated spreading mechanism incorporated in the stocking tube or support.

In contrast, the toe end closing apparatus of the present invention provides a relatively simple means of spreading the toe end and locating it suitably in the clamp, the spreading means is not clamped within the toe end and the possibility of poor positioning of the toe end and of damage thereto is thereby eliminated, and once the operator has positioned the toe end suitably on the stocking support, the whole operation is automatic, resulting in significant labor savings.

In addition, novel means is provided for restraining the stockings from slipping off the supports during the clamping and seaming operations.

Further, the present invention includes means for directing a stream of air onto the full width of the toe end extremity extending beyond the clamp, for directing the extremity into the seaming means, and this airstream is advantageously derived in the interest of energy efficiency from the exhaust produced by the suction means otherwise provided for everting stockings on the stocking supports.

SUMMARY OF THE INVENTION

Briefly described, the present invention provides an improvement in a stocking toe end closing apparatus of the type having seaming means and elongated stocking support means, the improvement provides movable expandable spreading means insertable into the open toe end of a stocking carried on the stocking support, and provides means for expanding the spreading means within the toe end and supporting and moving the spread toe end to a position adjacent the seaming means for closing.

The spreading means is inserted within the hollow end of the stocking support onto which an open stocking toe end has been manually drawn, and is expanded laterally to engage the extremity of the toe end and spread it to a width suitable for seaming, the stocking support end being formed to allow the expansion of the spreader therethrough. The expanded spreading means is then movable away from the stocking support end, carrying the widespread toe end extremity to a position beyond a clamping device located adjacent the seaming means. The clamping device is operated to clamp the widespread toe end in its spread position with its extremity outside the clamp, after which the spreading means is contracted to disengage it from the toe end and is moved along a return path for insertion into another toe end supported at the spreading position. The clamp is then moved past the seaming means for closing. Preferably, a stream of air is directed, as by a nozzle, onto the toe end extremity in the clamp for directing it into trimming means of the seaming means and for propelling the trimmings therefrom, and the clamp is preferably controlled to halt its movement past the seaming means after the toe end is closed so that a loop will form in the chain of stitches extending from the toe end to the still-operating seaming means to facilitate the severing of the chain by a cutter included in the seaming means.

Preferably, the stockings presented for closing are supported on a plurality of elongated tubular supports carried on an indexable carrier means which indexes each support sequentially to a spreading position and then to a seaming or closing position. The supports are provided with longitudinal slots in the open ends thereof for movement of a pair of fingerlike members of the spreading means laterally therethrough to spread the stocking toe end on the support. Transfer means moves the spreading means away from the support end in a path generally diagonal to the elongation of the stocking supports in synchronism with the indexing movement of the stocking supports from the spreading position to the seaming position so that the spreading means moves generally axially with relation to the supports, thereby partially withdrawing the stockings from the supports in carrying the widespread toe ends through the clamping means. The transfer means returns the spreading means to the spreading position after the clamping means clamps the stocking from the spreading means, and the clamping means moves the toe end extremity past the seaming means and for toe closing.

In the preferred embodiment of the invention, the stocking supports are tubular and are connected to a source of suction at their fixed ends at index positions before the spreading position and after the seaming position, and this suction is used for everting the stockings before and after spreading and seaming. The longitudinal slots in the open free ends of the supports are therefore provided with shiftable guard means for shielding the slots from interference with the everting of the stockings, and in this preferred form of the invention the guard means consists of tubular members arranged for relative rotational shifting on the tubular supports and provided with matching longitudinal slots in the corresponding ends thereof for shielding non-alignment with the slots in the ends of the supports and for exposing alignment with those slots to allow the fingerlike spreading members to pass therethrough at the spreading index position of the supports. Actuating means is connected to the guard means for engagement with engaging means for shifting the guard means.

The preferred clamping means has an arcuate shape and is mounted for rotation about its center. It comprises a plurality of separable clamping members between at least two of which the spreading means moves to locate the stocking toe end in the clamping means, and at least one of which is movable for clamp opening and closing movement with a closed position out of interference with the return movement of the spreading means. Means moves at least one of the clamping members past the seaming means for toe closing, and another of the clamping members is freely movable therewith. In the preferred embodiment, exhaust air provided by the suction means is the preferred source for a stream of air that is directed by a nozzle onto essentially the full width of the toe end extremity for extending the extremity outwardly into trimming means and for propelling the trimming therefrom.

Control means are included for rotating the clamping means for moving the stocking toe end past the seaming means for closing, which results in wrapping the clamped stocking about the clamping means. The control means operated to halt movement of the clamping means past the seaming means after completion of the toe end closing and formation of a chain of stitches beyond the toe end while allowing the seaming means to continue running to form a loop in the chain to facilitate severing of the chain by severing means. The control means is then operable to resume movement of the clamping means at a higher rate of speed than during seaming for pulling the chain into the severing means. Further, the control means is operable to move the clamping means in the opposite rotation in synchronism with the subsequent indexing movement of the stocking support for unwrapping and paying back the stocking.

Means are provided for restraining sliding movement of stockings on the supports during the time the stockings are at the clamps and during seaming, which is while the supports are located at the index position next beyond the spreading position and during a portion of the index movements to and away from that next beyond position. Preferably, the restraining means is an endless belt trained for free running around pulleys which support it for deflected engagement by the stocking supports.

BRIEF DESCRIPTION OF THE DRAWINGS

FIG. 3 is a right end elevational view of the stocking toe end closing apparatus of FIG. 1;

FIG. 4 is a plan view of the stocking toe end closing apparatus of FIG. 1;

FIG. 5 is an enlarged partial plan view of the stocking toe end closing apparatus of FIG. 1, showing the spreading, clamping, and closing area of the apparatus;

FIG. 7 is a further enlarged partial plan view showing details of the clamping control mechanism;

FIG. 8 is a further enlarged partial plan view showing details of the clamping control mechanism;

FIG. 14 is a partial phantom plan view corresponding to FIG. 9, showing details of the air distribution system;

FIG. 15 is a partial right end elevation view showing the stocking supports and their indexing base;

FIG. 16 is a longitudinal sectional view of a stocking support as taken along line 16—16 in FIG. 15;

FIG. 17 is a sectional view of the stocking support as taken along line 17—17 of FIG. 16; and FIG. 18 is an enlarged end elevational view of the stocking support at position D of FIG. 15.

DESCRIPTION OF THE PREFERRED EMBODIMENT

Figure 1:
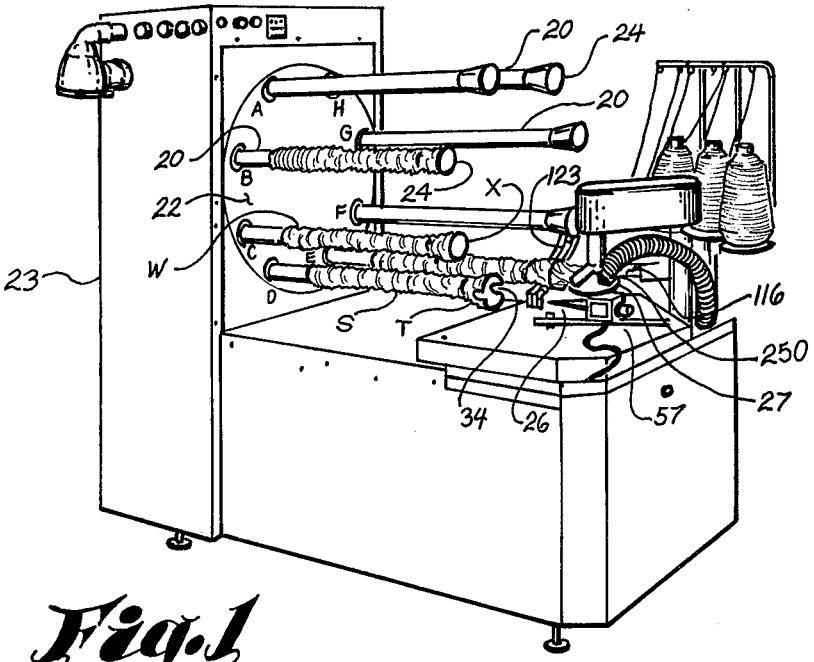
FIG. 1 is a perspective view of an automatic stocking toe end closing apparatus according to the preferred embodiment of the present invention and showing the general relation of the principal elements thereof.

In the illustrated preferred embodiment, stocking toe end closing apparatus is shown with stocking support tubes 20 mounted on an indexable carrier base 22 which is mounted for rotary indexing a machine frame 23 with the hollow free ends 24 of the supports 20 arranged to index to a spreading position where spreading means 26 can be inserted therein for spreading and moving a stocking toe end into a clamping means 27 for clamping and subsequent movement past toe end closing means 116.

In the illustrated embodiment, typical knit stockings S are shown in FIG. 1 to indicate the manner in which they are drawn onto and supported by the stocking support means 20 in the form of turning tubes. In this embodiment eight elongated turning tubes 20 are mounted on the circular rotatable base 22 for indexing in a direction transverse to their elongations and are spaced equidistantly from and equiangularly about the axis of rotation of the circular base 22 as shown in FIG. 3. Base 22 forms an indexable carrier means for the tubes 20 and has associated ratchet and pawl means for sequentially indexing the tubes 20 to and away from positions for supporting stockings for spreading and seaming and for everting thereafter. Thus, the tubes 20 will always be disposed at the positions or stations indicated as A to H except during the actual indexing motion of base 22. Typically of the art, the turning tubes 20 have tubular bores connected to a source of suction at certain of the index positions A to H for everting and controlling stockings at those positions. In the present invention the bores of the tubes 20 are connected to the vacuum source at positions B and F, but as a tube 20 is indexed from position A to position B it is connected to the vacuum source from an intermediate point just beyond position A to position B, while the tube 20 being indexed from E to F is connected to the source of vacuum from an intermediate point just beyond position E to position F.

The operator of this machine must perform certain manipulations on the stockings S as a preliminary to the full automatic subsequent operations, and while these manipulations are old in the art, they are performed as follows: first, the operator obtains a knit stocking S from a handy supply of stockings which are turned right-side-out; then, the operator presents the open toe end T of the stocking S to the hollow free end 24 of a turning table 20 as it is indexing toward or located at position B, and allows the stocking to be drawn toe end first into the bore of the tube 20 by the flow of air into the bore under the influence of the suction connected thereto; when the operator has allowed most of the stocking S to disappear into the bore of the tube 20, but still retaining control of the stocking S by holding the welt end W, the operator then draws the welt end W over the tube 20 toward the base 22 until the stocking S assumes the position as shown at position C in FIG. 6-1 with the stocking toe end extremity X located approximately coincident with the hollow free end 24 of the tube 20, turning the stocking inside-out in the process. There is a predetermined desirable location for the extremity X of the stocking toe end T with relation to the hollow free end 24, and a skilled operator may achieve this relation in initially drawing the stocking S over the support means 20, but if not achieved initially, this relation must be achieved by a final manual adjustment to the position of the extremity X. The eversion of the stocking S is normally accomplished at station B, station C is for the final positioning of extremity X, and the stocking S is indexed to station D, the spreading position, supported on a tube 20 with its extremity X in exact position for performance of the automatic operations to be described hereafter.

The automatic operations to be performed on a stocking S consist of the following: spreading the toe end T of the stocking S; moving the toe end T between the shaped clamps and clamping the toe end T therebetween with toe end extremity X hanging outside the clamps; moving the shaped clamps past seaming means for trimming off the extremity X just outside the shaped clamps; and closing the toe end T by seaming, allowing the stitching to continue beyond the toe end T while clamp movement ceases, to form a looped chain of stitches for cut-off so that the toe end T can be released by unclamping to be sucked back into the bore of the tube 20 for eversion again to right-side-out, and for air current conveyance away from the stocking toe end closing apparatus. The details of the preferred embodiment for accomplishing these manipulations and automatic operations are fully described hereafter.

Figure 2:
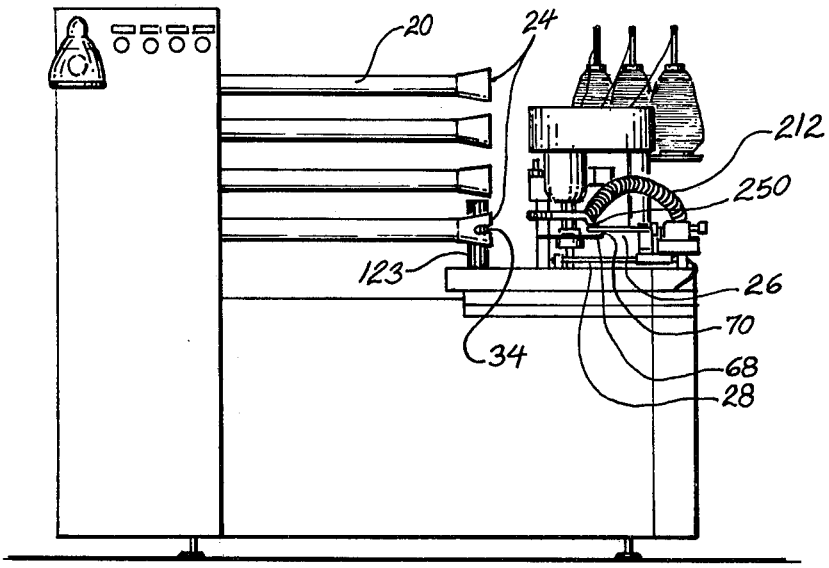
FIG. 2 is a left side elevational view of the stocking toe end closing apparatus of FIG. 1.
Figure 6:
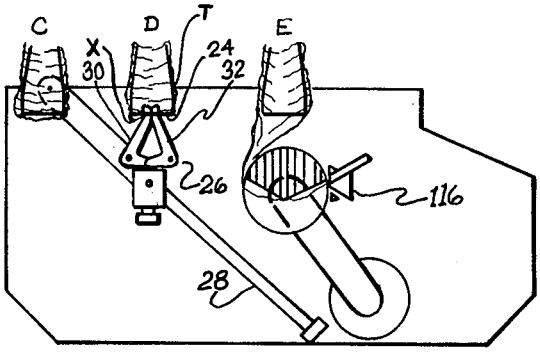
FIG. 6 is a series of six panels of partial plan views similar to FIG. 5, showing the progressive steps of spreading a stocking toe end, transferring it to the clamp means, and closing the toe end.
Figure 6:
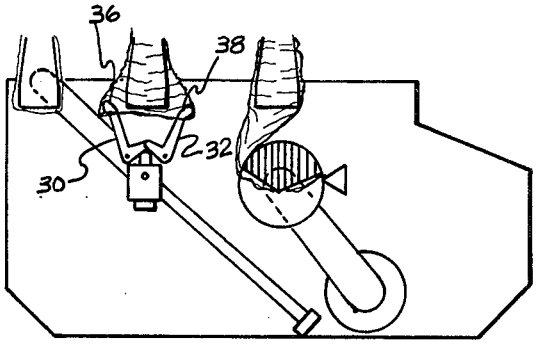
Figure 6:
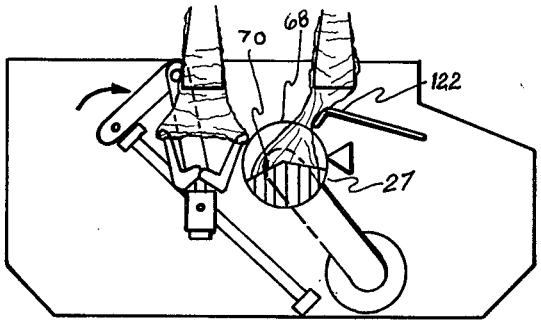
Figure 6:
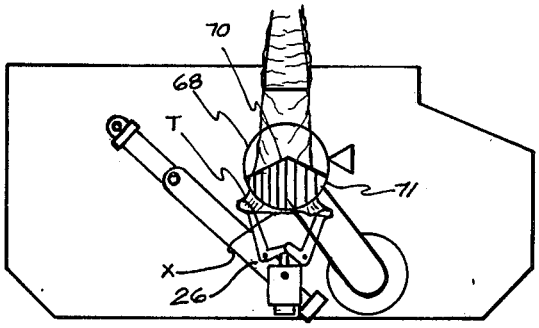
Figure 6:
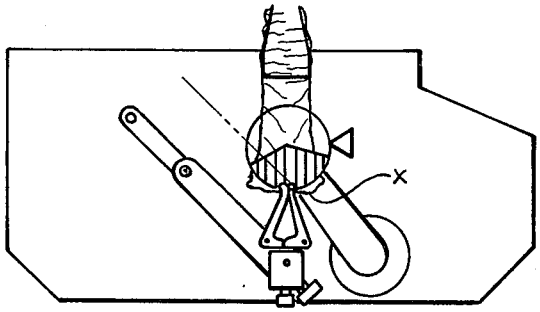
Figure 6:
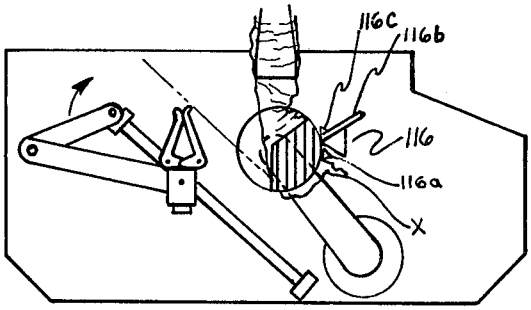

As best shown in FIG. 6-1, a movable stocking toe end spreading means 26 is mounted on a slide rod 28 for insertion movement for spreading. The spreading means 26 includes an opposed pair of spreading fingers 30 and 32 arranged for horizontal scissors action for contraction to a closed position as shown in FIG. 6-1 for insertion within the hollow free end 24 of a tube 20 from the open end thereof. As shown in FIG. 2, recesses in the form of longitudinal slots 34 are provided in the hollow free ends 24 of the tubes 20 so that the toe end spreading fingers 30, 32 may be expanded laterally from their inserted, contracted position within end 24 as shown in FIG. 6-1 to their spread or expanded position as shown in FIG. 6-2, on the exterior of the hollow end 24, spreader tips 36, 38 having passed laterally freely through the slots 34. Since the operator has previously positioned the toe end T adjacent the hollow end 24 with the open toe end extremity X at a position relative to hollow end 24 suitable for spreading by the spreader tips 36, 38, prior to the insertion therein of spreader fingers 30, 32, the stocking toe end T is engaged, supported, and held widespread laterally to a flat width suitable for seaming as shown in FIG. 6-2.

As shown in more detail in FIG. 5, the spreading fingers 30 and 32 are pivoted for spreading on pins 40 and 42 fixed in a slide block 44. Spreading fingers 30 and 32 are spread by the action of a solenoid device 46 mounted on the slide block 44 and having a movable plunger 48 bearing against lever arms 50, 52 of spreading fingers 30, 32 respectively. Springs 54, 56, stretched between lever arms 50, 52 and pins mounted in the slide block 44, act to return the spreading fingers 30, 32 to their contracted position when solenoid 46 is de-energized.

Transfer means 57 for moving the spreading means 26 is provided by the slide rod 28 journaled in the slide block 44 for reciprocation of the slide block 44 along the slide rod 28 sequentially between its insertion position as shown in FIG. 6-1, its transferred position for seaming as shown in FIG. 6-4, and return for another insertion; and the reciprocation is accomplished by constant speed rotation of a shaft 60 carrying a crank arm 58 by means of a connecting rod 62 which is pivoted at one end on a pin 64 at the outer end of the crank arm 58 and at its other end on a wrist pin 66 fixed in slide block 44.

As shown in FIG. 6-1, slide rod 28 is positioned diagonally with respect to the elongation of the turning tubes 20 for guiding the slide block 44 along the same diagonal direction for both insertion and return movements, and a synchronized drive means (explained hereafter) is provided for the slide block 44 and the index motion for the stocking support base 22 so that as slide block 44 moves away from the insertion position, with the spreading means 26 within the hollow end 24 at the index station D, the tube 20 at station D is generally simultaneously indexed laterally of its length or elongation to station E, and spreading means 26 remains essentially aligned and centered with respect to the tube 20 so that the stocking S is pulled generally axially for aligned partial withdrawal from the tube 20 and moved with expanded spreading means 26 to a fully transferred position, located for seaming, as in FIG. 6-4. FIG. 6-3 shows an intermediate stage of the transfer motion. As shown in the sequence of the transfer motion in FIGS. 6-2, 6-3, and 6-4, the expanded spreading finger 32 passes between a lower clamp disc 68 and an upper clamp foot 70 that are incorporated in the aforementioned clamping means 27. The fingers 32, 34 thus carry the expanded toe end T therebetween with its extremity X extending beyond the clamp members 68 and 70, and spreading fingers 30, 32 also lie beyond and outside the clamp members 68 and 70. Clamp disc 68 and clamp foot 70 are shown in FIG. 8 in their separated positions in solid lines, the foot 70 having been lifted from the disc 68, which is fixed from vertical movement but is journaled on a vertical shaft 72 in a support 74 for free rotation in the horizontal plane to follow the rotational movement of the foot 70 when clamped therewith, as shown in broken lines at 70', for moving the stocking toe end T for closing.

Clamp foot 70 is mounted on a pivot shaft 76 at the center of its arcuate clamping shape 71 for rotation in a horizontal plane as well as for sliding movement vertically. The rotational movement of the clamp foot 70 is achieved by means of a cam 78, shown in FIG. 7 fixed to a shaft 80 which is turned at the same constant rotation speed as the shaft 60 by a chain and sprocket drive 77 therefrom. The cam 78 acts on the follower end 82 of a gear section 84 which is pivoted on a pivot screw 86. As the cam 78 forces the follower end 82 away from the shaft 80, the gear teeth 88 on the gear section 84 move in a counterclockwise direction about a pivot screw 86, causing a meshing intermediate pinion gear 90 to turn in a clockwise direction, which in turn causes a driven pinion 92 mounted on the shaft 76 to turn in a counterclockwise direction. The pinion 92 is slidably keyed to the shaft 76 so that the clamp foot 70 turns counterclockwise with the pinion 92. After cam 78 has reached its maximum throw and continues turning, the follower end 82 returns toward the shaft 80 under the bias of a spring 91, reversing the gear train and allowing the segment 84 to return to its original position against a stop screw 94 while causing the clamp foot 70 to rotate in reverse back to its original position as shown in FIG. 8. This is the basic rotational position of the clamp foot 70 for receiving and clamping a stocking toe end and is the position in which it is shown in FIGS. 6-3, 6-4, and 6-5.

The shaft 76 is journaled for endwise sliding and for rotation in a support bracket 94 and is biased into its uppermost position as shown in solid lines in FIG. 8 by a spring (not shown) inside the bracket 94 acting against a collar (not shown) on the shaft 76 and a portion of the bracket 94. The shaft 76 is moved downwardly to close the foot 70 to the broken line position indicated by the numeral 70' against the disc 68 at a position below the spreading fingers 30, 32 by means of a set screw 96 adjustably fixed in the end of a rocker arm 98 which is pivoted on a pin 100 fixed in the bracket 94. The rocker arm 98 is actuated by a cam follower 102 fixed at the other end of the arm 98 in contact with a barrel cam 104, which is fixed to the constantly rotating shaft 80 shown in FIG. 7 and is contoured so that it forces the cam follower 102 upwardly and holds the clamp foot 70 in clamped position 70' during the major portion of the apparatus cycle, and during a minor portion of the cycle allows the shaft 76 and foot 70 to rise by virtue of the spring bias on shaft 76 for clamp opening movement.

The cams 78 and as shown in FIG. 7 form control means, and are contoured and coordinated with drive means for the slide block 44 of FIG. 5 and rotatable base 22 of FIG. 1 such that when the stocking toe end T has reached the position as shown in FIG. 6-4, the clamp foot 70 is forced downwardly to clamp the widespread toe end T between the foot to plate 70' and disc 68. Further rotation of the shaft 60 causes the contract cam 106 carried on the shaft 60 to contact the roller lever 108 of a microswitch 110 to actuate the microswitch 110 and thereby de-energize the solenoid 46, which is electrically dependent upon the microswitch 110, thereby allowing spreading fingers 30, 32 to contract, for releasing the toe end T and disengaging themselves from it to the position as shown in FIG. 6-5, and spreading fingers 30, 32 remain in contracted position for return movement past the clamp members 68 and 70 in their closed position out of interference with the return path of the spreading fingers 30, 32.

Still further rotation of the shaft 60 and thereby of the shaft 80 causes the lobe of seamer cam 112 as shown in FIG. 7 to lose contact with the roller lever 113 of a microswitch 114 mounted on the bracket 94. Deactuation of the microswitch 114 causes a sewing machine or seaming means 116 to operate, and still further rotation of shaft 80 causes foot 70 to rotate counterclockwise from its basic position as shown in FIG. 6-5 to carry the stocking toe end extremity X into the seaming means 116 as shown in FIG. 6—6 for closing. In the preferred embodiment illustrated the seaming means 116 is a conventional sewing machine of the type commonly used for stocking toe end closing, such as a Model 39500 Union Special sewing machine. Such sewing machines are conventionally equipped with a trimming or cutting means **116*a* which trims off the extremity X as it passes by the means 116*a* in trimming relation therewith before it reaches the sewing point of the machine 116, leaving only a suitable narrow fringe of the stocking toe end T extending outside the shaped clamps 68 and 70 for seaming. The foot 70 and disc 68 continue their rotation to the position shown in FIG. 6-1, interrupted only by the cam 78 having a dwell portion 118 (as shown in FIG. 7) after the sewing machine has completed the closing of the lateral extent of the widespread toe end T, while the sewing machine 116 continues to operate, forming a chain of stitches and creating a loop therein between the toe end T and the sewing point for facilitating sucking the chain into a conventional suction tube 116*b* for engaging and holding thereby. Further rotation of the cam 78 forces a farther and faster counterclockwise rotation of the clamp foot at position 70, by virtue of the steep rise 120 of the cam, for pulling the chain of stitches into engagement with a conventional cutter 116*c* on the sewing machine 116** provided for severing the chain of stitches.

Continued rotation of the shaft 80 as shown in FIG. 7 then causes the lobe of the cam 112 to contact the roller lever 113 of a microswitch 114 and thereby stops the operation of the sewing machine 116, and continued rotation of the shaft 80 causes the follower end 82 to ride onto and then off a dwell 121 on the cam 78 and then to move under spring bias toward the shaft 80, thereby causing the foot 70 and disc 78 to rotate clockwise in opposite direction to the seaming motion with the stocking end T still clamped therebetween so that some of the length of the stocking S is unwrapped and paid back toward the tube 20 which in the synchronization of movements has now started to move from index station E toward station F, dragging the stocking S around a guard 122 as shown in FIG. 6-3 for pulling toe end T from between the clamp members 68 and 70, which have been unclamped by action of the cam 104 after completion of their clockwise rotation, in a direction parallel to the length of the tubes 20 to keep the stockings clear of sewing machine 116. Concurrently with the renewed movement of the tubes 20, the spreading means 26 is moved in synchronization with the tubes 20, moving between index stations D and E to approach the clamp foot 70 with a stocking toe end T held widespread thereon as shown in FIG. 6-3. The continued rotation of the shaft 80 then allows the cam follower 102 to drop into a depression **104*a* in the barrel cam 104, allowing the clamp foot 70** to rise and release the stocking toe end T therefrom, as well as to provide clearance for the spreading finger 32 to move between the raised foot 70 and disc 68 along the path indicated in broken parallel lines just above the disc 68 in FIG. 8.

As shown in FIGS. 3 and 4, the tube 20 in moving toward index station E from the preceding spreading position at index station D has engaged and deflected an endless belt 123 that is trained around idler pulleys 124 for free-running thereabout at a distance back from the hollow end 24 of the tube 20 intermediate its length, and this slack belt 123 provides a suitable restraining force on the stocking S supported on the tube 20 to allow some sliding movement on the tube 20 but to restrain it from sliding completely off the tube 20 during the locating motion and during the seaming operation at the closing position at station E, and then continues to restrain the stocking S as the tube 20 advances from the index station E toward the index station F. Clamp foot 70 releases the stocking toe end T during this movement. A belt tensioning pulley 124' is movable for achieving a suitable tension or slackness in the belt 123. During the movement of the tube 20 from station E to station F, it is connected again to the source of suction; and the stocking toe end T, having been released by the clamp foot 70, is sucked back into the hollow bore of the tube 20, and during further movement of the tube 20 contact therewith by the slack belt 123 is lost so that continued suction on the toe end T completes the eversion of the stocking tube S by drawing the welt end W of the stocking S back over the hollow end 24 of the tube 20 and into the hollow bore so that the stocking S with its toe end T closed and turned right-side-out is conveyed by the suction away from the support means 20 and eventually out of the apparatus for collection.

It has been found that the slots 34 formed in the hollow ends 24 of the tubes 20 interfere with the everting of the stockings S, especially at the automatic eversion in the vicinity of index station F. Therefore, it is desirable to guard the slots 34 except at the index station D where they serve their useful purpose of permitting lateral passage of the spreading fingers 30, 32. Therefore, as shown in FIGS. 15–18, the tubes 20 include an inner tube 126 which is fixed to the rotating base 22, and a shiftable guard means in the form of an outer shiftable tubular sleeve 128 which is journalled for rotational oscillation on the inner tube 126. At the hollow free end 24 of the tubes 20 the inner tube 126 and the outer sleeve 128 are co-terminal, and the tube 126 and sleeve 128 are each provided with matching recesses or slots 34, so that the slots 34 may be aligned to expose them for passage of spreading fingers 30, 32 therethrough when the tubes 20 are positioned at index station D, and the slots 34 may be non-aligned to guard or shield them from interference with the everting of stockings S selectively as desired.

In the present invention, two actuating members or pins 130, 132 extend radially from the outer sleeve 128 near the rotating base 22, an exposing pin 130 extending toward the inside of the base 22, and a guarding pin 132 extending toward the outside of the base 22. Two engaging members or pins 134, 140 are provided to engage the actuating pins 130, 132 to rotate the outer sleeve 128 to its desired positions while moving toward and away from index station D, engaging pin 134 being supported by a bracket 136 attached to the stationary shaft 138 on which base 22 is journaled and engaging pin 134 being positioned inside the circle of tubes 20 and engaging exposing pin 130 as the tubes 20 are indexed toward index station D, thereby rotating the outer sleeve 128 counterclockwise with relation to the inner tube 126 and bringing the slots 34 of the tubes 126 and sleeves 128 into register or alignment. The outer sleeve 128 remains at this position relative to the inner tube 126 until the tubes 20 are indexed away from station D, and in its passage toward station E guarding pin 132 strikes the outer engaging pin 140 which is supported outside the circle of tubes 20 on the base 22 by a bracket 142 attached to the frame 23 of the apparatus. The engaging pin 140 moves the guarding pin 132 to rotate the outer sleeve 128 clockwise relative to the inner tube 126 so that the slots 34 in the tube 126 and sleeve 128 are non-aligned or completely out of register and are thereby shielded or guarded by the tube and sleeve respectively out of interference with stockings S during everting. The outer sleeve 128 then remains in this shielding or guarding position relative to the inner tube 126 during the remainder of its travel to index station E and subsequently back around past station C where the engaging pin 134 again engages the exposing pin 130.

Retaining screws 146 serve to fasten the sleeve 128 to an inner bushing 148 which is free to rotate on the inner tube 126 except as restrained by pins 150 and 152 fixed in the base 22 in the rotational path of the engaging pins 130 and 132 respectively so that the pins 130 and 132 are held within a suitable angular working range. A set screw collar 154 fixed to the tube 126 beside the bushing 148 serves to retain the sleeve 128 from endwise movement off the tube 126.

Figure 9:
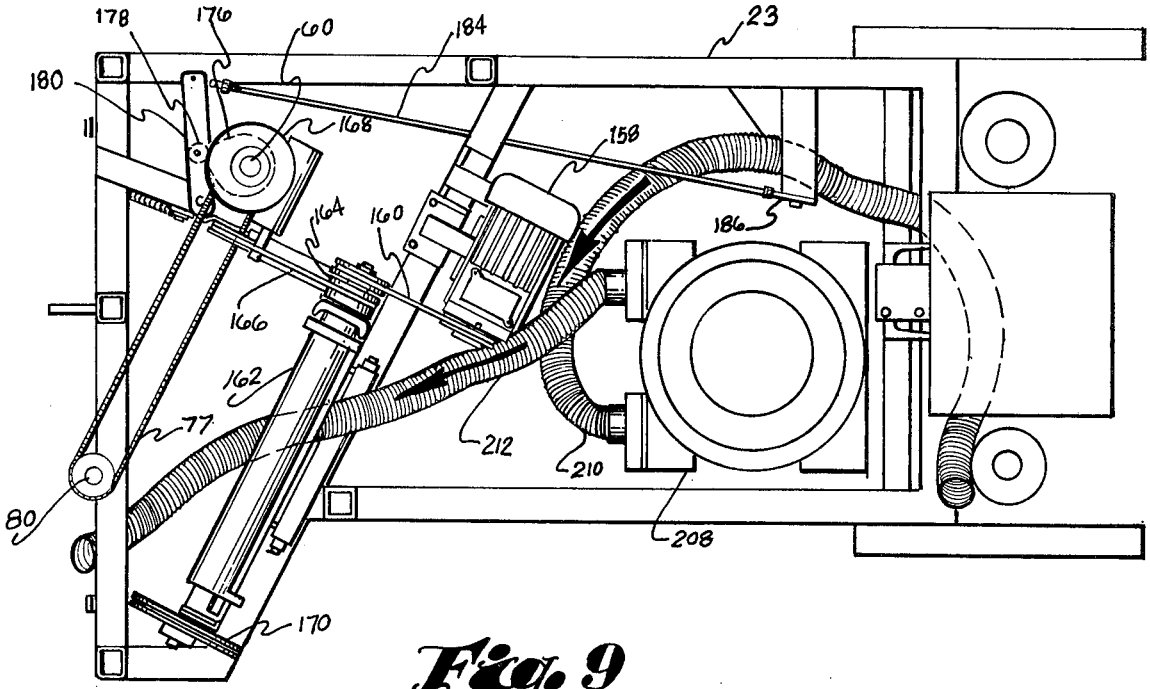
FIG. 9 is an enlarged horizontal sectional view taken along the line 9—9 of FIG. 3.
Figure 10:
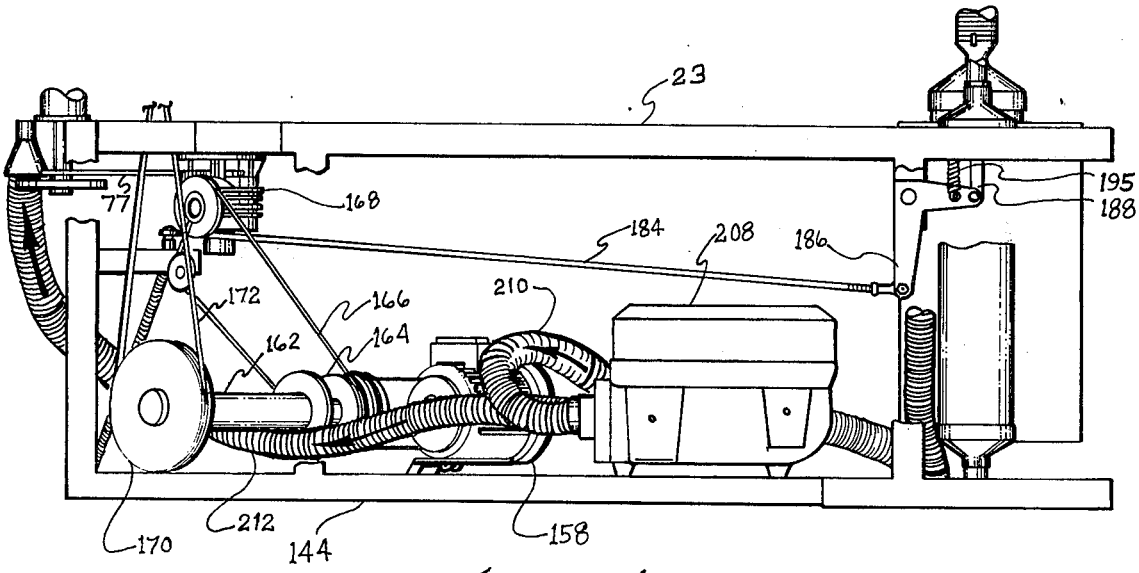
FIG. 10 is a partial broken-away rear view of the base section of the stocking toe end closing apparatus of FIG. 1.
Figure 11:
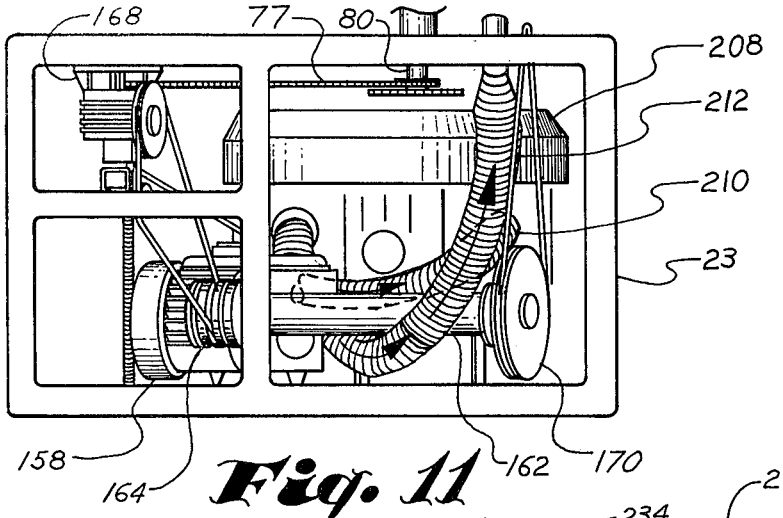
FIG. 11 is a partial broken-away right end view of the base section of the stocking toe end closing apparatus of FIG. 1.
Figure 12:
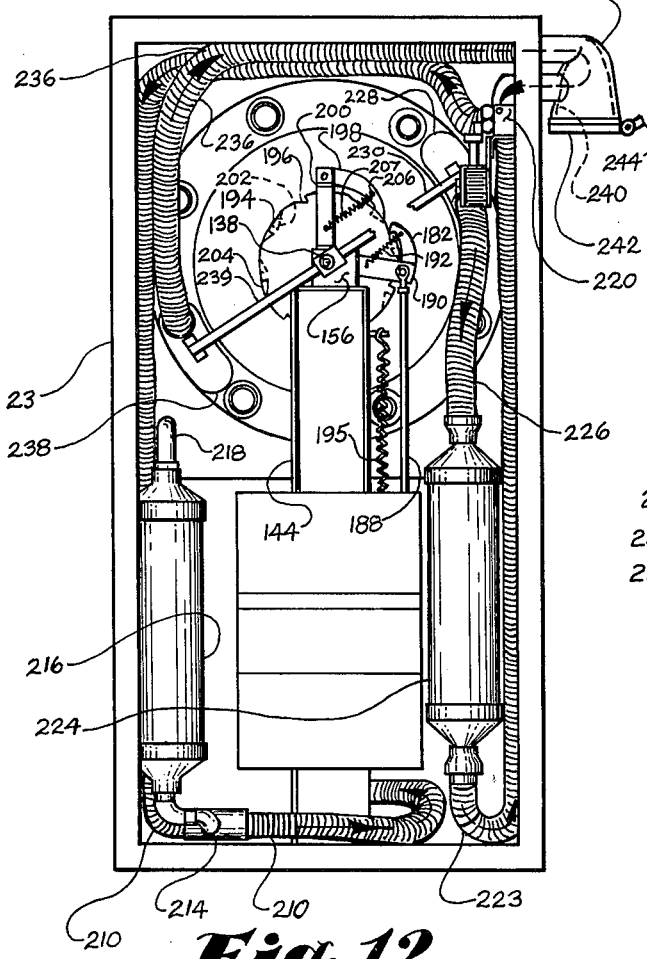
FIG. 12 is a left end elevation view of the stocking toe end closing apparatus shown in FIG. 1.
Figure 13:
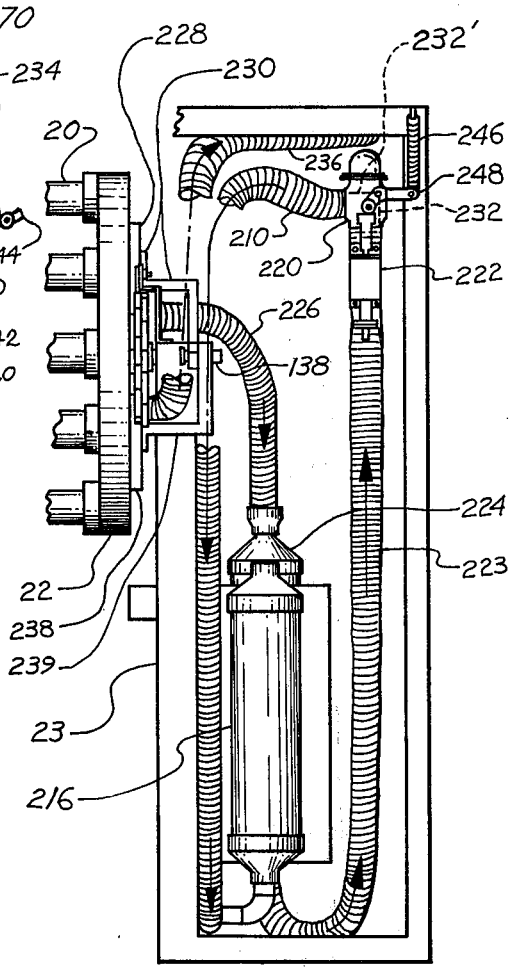
FIG. 13 is a partial broken-away rear elevation view of the stocking toe end closing apparatus of FIG. 1.

As shown in FIGS. 12 and 13, the stationary shaft 138 on which the circular base 22 is journaled is mounted in a shaft support 156 which is in turn supported on the apparatus frame 23. Means for driving the apparatus, as shown in FIGS. 9 and 10, includes an electric motor 158 provided with suitable controls and mounted on the frame 23. A belt drive 160 from the motor 158 to a jack shaft 162 provides a convenient means for applying and controlling the motor power. A magnetic clutch device associated with a pulley 164 on the jack shaft 162 determines whether the pulley 164 drives from or idles on the jack shaft 162, and, when driving, transmits power through a belt drive 166 to a gear box 168 from which extends the aforesaid vertical output shaft 60 for reciprocating the spreading means 32. Another magnetic clutch device associated with a pulley 170 on the jack shaft 162 determines whether the pulley 170 is driven from or idles on the jack shaft 162, and, when driving, transmits power from the motor 158 by means of belt drive 172 to the sewing machine 116. The aforementioned chain drive 77 drives the vertical shaft 80 from the output shaft 60 for operation of the clamp foot 70.

A downward extension of the shaft 60 below the gear box 168 has a cam 176 fixed thereupon for indexing the support base 22. The cam 176 drives a cam roller 178 mounted on a pivoted lever arm 180 that is connected to an index pawl 182, as shown in FIG. 12, by a connecting rod 184, bell crank 186, connecting rod 188, and the usual associated pins and rod ends. The pawl 182 is pivoted at the end of an arm 190 which itself is journaled on a stationary shaft 138, and a spring 192 holds the pawl 182 in engagement with an index ratchet 194 which is fixed to the support base 22 for rotational indexing therewith. The cam roller 178 is held against the cam 176 by the action of a spring 195 on the bell crank 186, so that the pawl 182 reciprocates through an angle somewhat greater than 45° about the ratchet 194, engaging at each downward stroke an index tooth 196, one of eight equally spaced on the ratchet 194, and pulling the tooth through a 45° rotational index about the shaft 138. A stop pawl 198 pivoted from a stationary support 200 mounted on the shaft support 156 prevents over-indexing of the base 22 and provides a detent against reverse rotation by its spring-biased engagement with a stop tooth 202, one of eight equally spaced on a stop ratchet 204 also fixed to the base 22 for rotation therewith. These stop teeth 202 are suitably oriented with respect to the teeth 196 in indexing the ratchet 194 for synchronization of the indexing and holding actions. The index pawl 182 on its upward stroke rides beneath a pin 206 fixed on the stop pawl 198 and lifts the stop pawl 198 from the stop ratchet 204 to free the stop ratchet 204 for rotation, and during the downward stroke of the index pawl 182 it moves from beneath the pin 206, allowing the stop pawl 198 to rest again on the periphery of the stop ratchet 204, biased thereagainst by a spring 207, for engagement with the next tooth 202.

The aforementioned suction source is in the form of a suction or vacuum unit 208 equipped with its own electric drive motor, as shown in FIG. 10, with a flexible suction hose 210 extending from the suction or vacuum inlet thereof to the rear end of the apparatus, while another flexible pressure hose 212 extends from the exhaust or pressurized air outlet of the suction unit to the vicinity of the clamp foot 70 for purposes to be explained later. As shown additionally in FIGS. 11 to 14, the suction hose 210 reaches a junction 214 at the rear of the apparatus where a filter and material recovery unit 216 is connected to the hose 210, and the suction hose 218 runs from the filter unit 216 to the suction tube 116B of the sewing machine 116. The suction hose 210 continues on from the junction 214 to a valve mechanism 220 controlled by a solenoid device 222 which is controlled by a suitable cam and microswitch located directly beneath the cam 112 and microswitch 114 respectively as shown in FIG. 7. Through a suction hose 223, the valve unit 220 connects suction from the hose 210 to another filter and material recovery unit 224 which in turn is connected by a suction hose 226 to a sliding suction shoe 228 which is mounted to slide against the rear side of base 22 for connecting suction for everting stockings to the bores of tubes 20 as these bores pass under the shoe 228 by the indexing of base 22. The shoe 228 is held against the base 22 and in proper angular orientation therewith by an arm 230 clamped to the stationary shaft 138. Thus any stocking or waste material inadvertently sucked through a tube 20 while under the shoe 228 will be sucked into the recovery unit 224 for retrieval therefrom.

The valve unit 220 is equipped internally with a damper 232 shown in open position in heavy broken line and controlled by the solenoid device 222. In open position, the damper 232 connects the suction from the hose 210 to a stocking separation unit 234 which is in turn connected by a suction hose 236 to another suction shoe 238 similar to the aforementioned suction shoe 228, but located generally behind index station E of the base 22 by an arm 239 clamped to the shaft 138, to supply suction to the bore of the tubes 20 at that station for everting stockings after toe closing, and for sucking the everted stockings therefrom and transmitting them by the suction air currents to the stocking separation unit 234 where they are held by the internal screen 240 of the separation unit 234 until the damper is operated to its closed position 232' to cut off suction from the separation unit 234. When suction is removed from the separation unit 234, a biased sealing door 242 opens from the weight of the stockings thereon to let the stockings fall out into a suitable receptacle (not shown). A counterweight 244 serves to reclose the door 242 after the stockings have fallen out so that the separation unit functions normally again when suction is reconnected thereto by opening of the damper 232 by the spring 246 connected thereto by lever means 248 when the solenoid unit 222 is deenergized by action of its associated cam and switch. The suction shoes 228, 238 may be adjusted angularly to positions behind such index stations as may be suitable for operation of the apparatus.

Referring to FIGS. 5, 6 and 8, the toe end extremity X as shown in FIG. 6-5 after clamping between the clamp members 68, 70 is loose, curled, and wrinkled. To facilitate guiding the extremity X into the trimmer 116*a*, as shown in FIG. 6-6, and to propel the trimmings away therefrom, an air nozzle 250 is provided as shown in FIGS. 5 and 8, free to move vertically with the clamp foot 70, but fixed from rotation by a pin 251 fixed to the nozzle 250 for vertical sliding through a hole in the bracket 94. The air nozzle 250 is substantially coextensive angularly with the clamp foot 70 at its basic toe end receiving position as shown in FIG. 6-5; and, as shown in FIG. 8 in cross section, the nozzle mount 252 is shaped and positioned to direct a stream of exhaust air 254 past the toe 256 of the clamp foot 70 and onto the extremity X of a toe end clamped thereby, and forms a means of directing a stream of air onto essentially the full width of the toe end extremity X. This stream 254 of exhaust air from the suction unit 208 acts to extend the toe end extremity X outwardly of the clamp members 68, 70 and to direct it into the cutting device 116*a* during its movement to the seaming means 116. The nozzle hose 212 thereto, and alternatively, it might be connected to some other source of pressurized air, though the use of the exhaust air from the otherwise necessary suction unit is advantageous for simplicity and power savings. A suitable chute 260 is provided below the clamp member 68 for receiving the trimmings from extremities X as directed there by the air stream 254.

If desired, a helper roller 262 may be mounted on the frame 23 for engagement by tubes 20 intermediate their ends when they are at the everting station F. This roller 262 is of soft deformable material, such as foam plastic, to permit movement of the tubes 20 therepast and is driven by suitable means for rotation in a direction to apply a force on a stocking S on the tube 20 toward the open end thereof, thereby assisting everting of the stocking through and from the tube 20.

The particular embodiment disclosed in full detail herein and illustrated in the drawings has been provided for disclosure purposes only and is not intended to limit the scope of the present invention, which is to be determined by the scope of the appended claims.

I claim:

1. In a stocking toe end closing apparatus having seaming means for closing toe ends of stockings and elongated stocking support means for supporting stockings with an open toe end at a spreading position, the improvement comprising:

(a) movable expandable spreading means insertable while contracted into said support means and the open toe end of a stocking carried on the support means at the spreading position from the exterior of the toe end thereof and expandable after insertion to support the open toe end and spread it laterally to a flat widespread width suitable for seaming; and (b) transfer means for causing sequential movement of said spreading means into the toe end of a supported stocking from the toe end thereof, movement of said spreading means in relation to said support means to a position adjacent said seaming means for locating said spread toe end for seaming, and return movement of said spreading means for subsequent insertion movement thereof.

2. In stocking toe end closing apparatus, the improvement according to claim 1 and characterized further by said stocking support means having a hollow free end formed to accommodate movement of said spreading means laterally from within said support means to the exterior thereof to engage and spread a stocking toe end supported thereon for movement with said spreading means for said locating for seaming.

3. In stocking toe end closing apparatus, the improvement according to claim 2 and characterized further in that said spreading means comprises a pair of laterally spreadable fingerlike members, and in that the hollow free end of said support means has longitudinal slots therein for movement of said fingerlike members laterally therethrough.

4. In stocking toe end closing apparatus having seaming means for closing toe ends of stockings, the improvement comprising:

(a) clamping means located for clamping a stocking toe end and moving it past said seaming means for closing;

(b) elongated stocking support means for supporting a stocking with an open toe end at a spreading position;

(c) movable expandable spreading means insertable while contracted into said support means and the open toe end of a stocking carried on the support means at the spreading position and expandable after insertion to support the open toe end and spread it laterally to flat widespread width suitable for seaming;

(d) transfer means for causing sequential insertion movement of said spreading means into the toe end of a supported stocking from the exterior of the toe and extremity thereof, movement of said spreading means in relation to said clamping means to a position for locating the supported widespread toe end in said clamping means for clamping thereby with its extremity outside thereof, and return movement of said spreading means for subsequent insertion movement thereof; and (e) means for expanding said spreading means after said insertion movement thereof within a stocking toe end and for contracting said spreading means to release the toe end of the stocking after it is clamped by said clamping means.

5. In stocking toe end closing apparatus, the improvement according to claim 4 and characterized further by said stocking support means having a hollow free end formed to accommodate movement of said spreading means laterally from within said support means to the exterior thereof to engage and spread a stocking toe end supported thereon for movement with said spreading means for said locating in said clamping means.

6. In stocking toe end closing apparatus, the improvement according to claim 5 and characterized further in that said spreading means comprises a pair of laterally spreadable fingerlike members, and in that the hollow free end of said support means has longitudinal slots therein for movement of said fingerlike members laterally therethrough.

7. In stocking toe end closing apparatus, the improvement according to claim 6 and characterized further in that said support means has a tubular configuration for everting stockings and by shiftable guard means operable with said support means for shielding the longitudinal slots therein to prevent interference of the slots with the everting of stockings.

8. In stocking toe end closing apparatus, the improvement according to claim 7 and characterized further in that said guard means has a tubular configuration and has an end having slots therein for exposing alignment and shielding non-alignment with the slots in the hollow free end of said support means by relative rotational shifting between the guard means and the support means.

9. In stocking toe end closing apparatus, the improvement according to claim 7 and characterized further by:

(a) a frame;

(b) an indexable carrier means mounted on said frame;

(c) a plurality of said support means mounted on said carrier means;

(d) means for indexing movement of said support means mounted on said carrier means sequentially to and away from said spreading position; and (e) means for shifting said guard means to expose the longitudinal slots at said spreading position and to shield the slots at other positions of the support means.

10. In stocking toe end closing apparatus, the improvement according to claim 9 and characterized further by:

(f) actuating means connected to said guard means; and (g) engaging means connected to said frame, said actuating means being operable by engagement with said engaging means for said shifting of said guard means.

11. In stocking toe end closing apparatus, the improvement according to claim 9 and characterized further in that each of said guard means has an end having slots therein for exposing alignment and shielding non-alignment with the slots in the hollow free ends of said support means by relative rotational shifting between the guard means and the support means.

12. In stocking toe end closing apparatus according to claim 4 and having means included in said seaming means for trimming off the extremity of the toe end suitable for seaming, the improvement characterized further by means for directing a stream of air onto essentially the full width of the extremity of a stocking toe end in said clamping relation with said clamping means for extending said extremity outwardly of said clamping means during the movement of said extremity to said seaming means.

13. In stocking toe end closing apparatus according to claim 4 and having means included in said seaming means for trimming off the extremity of the toe end suitable for seaming, where said support means is tubular, and means are included for creating suction and producing an exhaust of air therefrom, and where the bore of said support means is connected to said suction means for everting stockings at said support means: the improvement comprising means for directing a stream of said exhaust air onto said extremity of a stocking toe end in said clamping relation with said clamping means for directing said extremity into said trimming means and for propelling the trimmings therefrom.

14. In stocking toe end closing apparatus, the improvement according to claim 4 and characterized further in that said position of said spreading means for locating the widespread toe end in said clamping means comprises a position adjacent, beyond said clamping means.

15. In stocking toe end closing apparatus, the improvement according to claim 4 and characterized further by said movable clamping means comprising a plurality of separable clamping members between at least two of which said spreading means moves to locate the toe end in the clamping means, and at least one of said members being movable for clamp opening and closing movement and having a closed position out of interference with said return movement of said spreading means.

16. In stocking toe end closing apparatus, the improvement according to claim 15 and characterized further by means for moving at least one of said clamping members past said seaming means for toe end closing, and another of said clamping members being freely movable for movement with said last mentioned clamping member past said seaming means when said clamping members are in said closed position.

17. In stocking toe end closing apparatus, the improvement according to claim 4 and characterized further by:

(a) a frame
(b) an indexable carrier means mounted on said frame
(c) a plurality of said elongated stocking support means mounted on said carrier means, and
(d) means for indexing movement of said carrier means for indexing said support means to and away from said spreading position in a direction transverse to their elongation.

18. In stocking toe end closing apparatus, the improvement according to claim 17 and characterized further by said transfer means moving said movable spreading means in a generally diagonal direction relative to the elongation of said support means and in synchronism with said indexing movement so that the spreading means moves generally axially with respect to said support means during their respective movements from said spreading position for aligned partial withdrawal of the stockings from the support means to position the stocking toe ends in said clamping means.

19. In stocking toe end closing apparatus, the improvement according to claim 17 and characterized further by said transfer means moving said movable spreading means in a generally diagonal direction relative to the elongation of said support means and in synchronism with said indexing movement so that the spreading means moves generally axially with respect to said support means during their respective movements from said spreading position for aligned partial withdrawal of the stockings from the support means to position the stocking toe ends in said clamping means, and in that said return movement of said spreading means is along generally the reverse of said diagonal direction.

20. In stocking toe end closing apparatus the improvement according to claim 17 and characterized further by means for restraining sliding movement of stockings on said supports, said restraining means comprising:

(a) a belt,
(b) means supporting said belt for free-running deflected engagement by said supports while located at the index position next beyond said spreading position and during a portion of the index movements to and away from said next beyond index position.

21. In stocking toe end closing apparatus the improvement according to claim 17 and characterized further by means for restraining sliding movement of stockings on said supports, said restraining means comprising:

(a) an endless belt,
(b) pulleys supporting said belt for free-running deflected engagement by said supports intermediately of their lengths while located at the index position next beyond said spreading position and during a portion of the index movements to and away from said next beyond index position, and
(c) means for tensioning said belt suitably for said slidable retention of stocking tubes thereby.

22. In stocking toe end closing apparatus having seaming means for closing toe ends of stockings, elongated support means indexable transversely to said elongation to and away from a position for supporting said stockings for closing the toe ends thereof, and means for withdrawing said stockings partially from said support means in preparation for and during said closing; the improvement comprising means for restraining stockings on said supports, said restraining means comprising:

(a) a belt, and
(b) means supporting said belt for free-running deflected engagement by said support means during at least a portion of the movement of said support means to and away from said closing position and while at said closing position.

23. In stocking toe end closing apparatus according to claim 4 wherein the seaming means forms seaming stitches continuing after seaming of the lateral extent of a widespread toe end to form a chain of stitches between said seaming means and said toe end, and the seaming means includes means for severing the chain of stitches, the improvement comprising control means operable to halt the movement of said clamping means past said seaming means after completion of the toe end closing and formation of a chain of stitches beyond said toe end while allowing said seaming means to continue running to form a loop in the chain of stitches to facilitate severing by the severing means.

24. In stocking toe end closing apparatus, the improvement according to claim 23 and characterized further by said control means being operable, after said loop forming, to resume movement of said clamping means past said seaming means at a higher rate of speed than during said seaming for pulling said chain of stitches into said severing means.

25. In stocking toe end closing apparatus, the improvement according to claim 4 and characterized further by:

(a) a frame,
(b) an indexable carrier means mounted on said frame,
(c) a plurality of said elongated stocking support means mounted on said carrier means,
(d) means for indexing movement of said carrier means for indexing said support means to and away from said spreading position in a direction transverse to their elongation, (e) said clamping means having an arcuate shape and being mounted for rotation about the center thereof, and (f) control means operable for rotating said clamping means for said moving said toe end past said seaming means for said closing while wrapping said clamped stocking about said clamping means, said control means being operable for moving said clamping means in opposite rotation thereafter in synchronism with the subsequent indexing movement of said stocking support means for unwrapping and paying back said stocking during said indexing movement.

26. In stocking toe end closing apparatus having seaming means for closing toe ends of stockings, clamping means located for engaging and holding widespread a stocking toe end and movable for moving said toe end past said seaming means for closing by seaming, a frame, an indexable carrier means mounted on said frame, a plurality of elongated stocking support means mounted on said carrier means for supporting stockings with an open toe end at a position for said toe end closing, and means for indexing movement of said carrier means for indexing said support means to and away from said toe end closing position; the improvement characterized by:

(a) said clamping means having an arcuate shape and being mounted for rotation about the center thereof, and (b) control means operable for rotating said clamping means for said moving of said toe end past said seaming means for said closing while wrapping said clamped stocking about said clamping means, said control means being operable for moving said clamping means in opposite rotation thereafter in synchronism with the subsequent indexing movement of said support means away from said toe end closing position for unwrapping and paying back said stocking during said indexing movement.

* * * * *

UNITED STATES PATENT OFFICE

CERTIFICATE OF CORRECTION

Patent No. 4,133,276 Dated January 9, 1979

Inventor(s) Fabio Selvi

It is certified that error appears in the above-identified patent and that said Letters Patent are hereby corrected as shown below:

Col. 3, line 36, delete "operated" and insert therefor --operates--. Col. 7, line 53, after "and" insert --104--. Col. 7, line 59, after "foot" delete "to plate" and insert therefor --at position--. Col. 7, line 60, after "shaft 60" insert --of Fig. 5.--. Col. 13, line 44, delete "and" and insert therefor --end--.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*